United States Patent [19]

Macchi

[11] 4,257,407

[45] Mar. 24, 1981

[54] NEGATIVE PRESSURE RESPIRATOR SHELLS

[76] Inventor: Pier G. Macchi, 3 French St., Burwood, Victoria, Australia

[21] Appl. No.: 952,773

[22] Filed: Oct. 19, 1978

[30] Foreign Application Priority Data

Oct. 21, 1977 [AU] Australia ..... PD2154
Feb. 9, 1978 [AU] Australia ..... PD3315

[51] Int. Cl.[3] ..... A61H 31/02
[52] U.S. Cl. ..... 128/30.2; 128/298
[58] Field of Search ..... 128/30.2, 30, 31, 297, 128/298, 299

[56] References Cited

U.S. PATENT DOCUMENTS

| | | | |
|---|---|---|---|
| 230,351 | 7/1880 | Seyberlich | 128/298 |
| 1,670,301 | 5/1928 | Eisenmenger | 128/298 |
| 1,864,700 | 6/1932 | Wade | 128/297 |
| 2,036,248 | 4/1936 | Acklen | 128/30.2 |
| 2,067,268 | 1/1937 | Hans | 128/30.2 |
| 2,456,724 | 12/1948 | Mullikin | 128/30.2 |
| 2,480,980 | 9/1949 | Terhaar | 128/30.2 |
| 2,772,673 | 12/1956 | Huxley | 128/30.2 |
| 3,078,842 | 2/1963 | Gray | 128/30.2 |

*Primary Examiner*—John D. Yasko
*Attorney, Agent, or Firm*—O'Brien & Marks

[57] ABSTRACT

A portable negative pressure respirator shell comprising a plurality, typically two, of rigid shell sections co-operable to provide an open ended shell for a patient's torso. Variable resilience flexible sealing lips are disposed along the top and bottom edges of the shell sections to aid in providing an airtight engagement with the body surface of the patient on the application of a negative pressure to said chamber, which engagement may be relieved by a suitable greater pressure in said chamber. The sealing lips are advantageously of reducing thickness and directed inwardly. Also disclosed are a power unit and reciprocatory valve for use with the respirator.

13 Claims, 13 Drawing Figures

NEGATIVE PRESSURE RESPIRATOR SHELLS

FIELD OF THE INVENTION

This invention relates to portable negative pressure respirator shells and to a power unit and reciprocating valve for such shells.

BACKGROUND OF THE INVENTION

Conventional iron lungs are bulky and cumbersome box-like units which require heavy power units. They can be transported only when separated from the patient and even then with considerable difficulty. Most iron lung patients are quadraplegic poliomyelitis victims and many are cared for in private homes. If it is desired, for example, to take an iron lung dependant on an outing, he must be removed from the lung and placed on a mask respirator to allow the iron lung to be loaded into a van or truck and delivered to the intended site.

In order to at least in part alleviate the inherent disadvantages of iron lungs, various types of respirator shells or half-shells have been proposed. These are intended to be worn virtually as an additional garment and thereby be transported with the patient. However the employment of shells for artificial respiration of paralysis patients has been less than successful in that it has proven difficult to secure a satisfactory airtight seal against the patient's skin at the upper and lower margins of the shell. The majority of prior respiratory shells have been of a type which pass over the shoulders of the patient and accordingly have separate sealed openings for the neck and arms. Reference is made in this respect to U.S. Pat. Nos. 2,270,313 (Kraft) 2480980 (Terhaar) and 2529258 (Lobe) each of which describes a continuous expansible uniformly thick neck seal of conical form to allow for varying neck thicknesses and to enhance the seal during the vacuum stroke of the respiration cycle.

In order to avoid the need for four sealed openings, two alternative arrangements have been proposed. The first of these, the so-called Monaghan technique, entails the application of a half-shell to the ventral part of the supine patient. U.S. Pat. No. 2,287,939 (Kraft) for example, described such a device having a continuous very soft resilient sealing lip or flap which extends from an inflated tube at the edge of the rigid half-shell.

The second alternative is the provision of a shell which extends only to a single upper opening in the vicinity of the chest, but this involves the difficulty of sealing across the chest area.

U.S. Pat. No. 2,241,444 (Bower) refers to an arrangement of this kind and also describes side clamps holding the shell sections together. Bower also describes in some detail the custom manufacture of the shell sections from initial plaster cast of the patient's torso. The sealing rings are simple internal gaskets at the peripheries of the shell sections.

U.S. Pat. No. 3,368,550 (Glascock) describes and illustrates upper and lower sealing lips which extend inwardly onto the patient's body from outstanding locating flanges and which are held in sealing engagement with the skin by respective bands.

Reference is also made to U.S. Pat. Nos. 2,833,275 (Tunnicliffe), 2,456,724 (Mullikin) and 2,588,192 (Akerman et al) for further examples of prior shell—type respirator devices.

It is an object of the invention to provide an improved portable negative pressure respirator shell capable of satisfactory airtight sealing engagement with the skin at least during the vacuum application stroke.

SUMMARY OF THE INVENTION

The invention accordingly provides, in one aspect a portable negative pressure respirator shell comprising a plurality of generally curved and rigid shell sections co-operable to provide an open ended shell which embraces a patient's torso when worn by the patient, being positioned to extend downwardly from over the chest about the diaphragm and abdomen to define a chamber between the shell and the patient's torso, and variable resilience flexible sealing lips disposed along the top and bottom edges of the shell sections to aid in providing an airtight engagement with the body surface of the patient on the application of a negative pressure to said chamber, which engagement may be relieved by a suitable greater pressure in said chamber.

It will be appreciated that the shell fits in such a manner as to leave the head and limbs of the wearer outside and free, much in the way a turtle shell covers the body of a turtle.

The sealing lips may be rendered of variable resilience by forming them with reducing thickness in a direction outwardly of said top and bottom edges.

The power unit for applying the periodic suction and return of air to the body encircling chamber provided by the respirator device may include an hydraulically actuated bellows. In one very satisfactory arrangement, a small power electric motor drives an hydraulic pump. Such an arrangement requires a reciprocating valve by which the hydraulic fluid is applied by the pump to the bellows actuating cylinder. In accordance with a further aspect of the invention, a suitable valve comprises:

a valve body;

fluid inlet means for admitting fluid to the interior of the body;

a pair of fluid outlet ports at spaced locations in the valve body, each communicatable with the inlet means by way of respective fluid flow passages in the valve body;

a first sliding member reciprocable between respective positions in which it attains a maximum thrust into said fluid flow passages in turn;

a second sliding member reciprocable along a line spaced from but substantially parallel to the line of reciprocation of the valve member;

respective means coupled to the second sliding member to alternately open and close said fluid flow passages in dependance on the position of the relative member; and compression spring means coupling the first and second sliding members and arranged to bias the members to opposite limits of their lines of movement, the arrangement being such that the first sliding member is moveable against the spring means in response to a predetermined fluid pressure in the flow passage into which it is then projecting to a position just beyond the point at which maximum compression of the spring means is attained, whereby the spring means acts to move both sliding members to invert the limit positions of the sliding members.

An alternative power unit in accordance with the invention comprises structure defining a cavity communicable with the interior of the respirator shell;

means for applying continuous air suction to said cavity and;

valve means to intermittently and temporarily reduce the degree of vacuum in said cavity.

BRIEF DESCRIPTION OF THE DRAWINGS

The various aspects of the invention will now be described in greater exemplary detail with reference to the accompanying drawings, in which.

DESCRIPTION OF THE PREFERRED EMBODIMENTS

Figure 1:
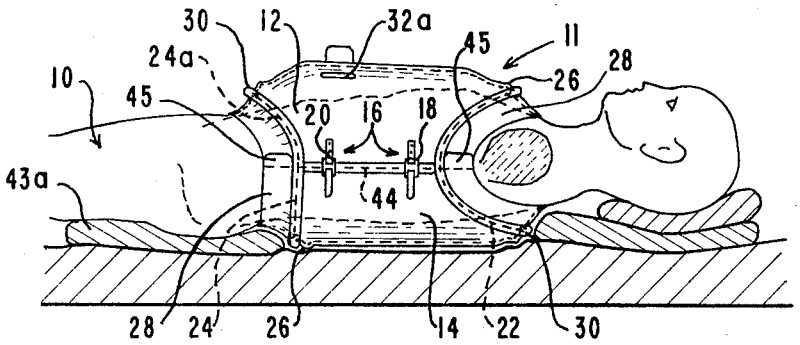
FIG. 1 depicts in somewhat diagrammatic side elevation, a supine patient wearing a respirator shell in accordance with the invention, the patient's arm being sectioned for enhanced clarity.
Figure 3:
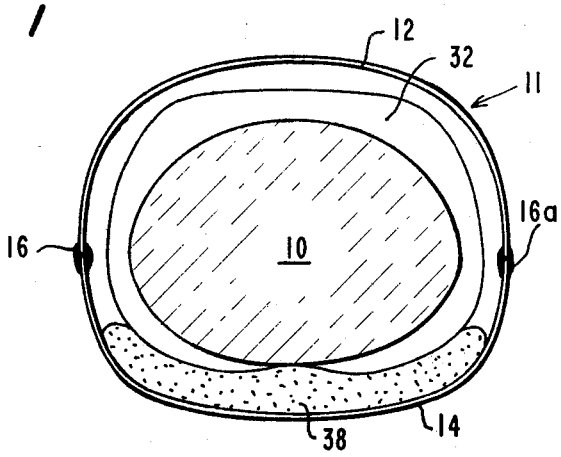
FIG. 3 is a cross-section on the line 3—3 of FIG. 1.
Figure 2:
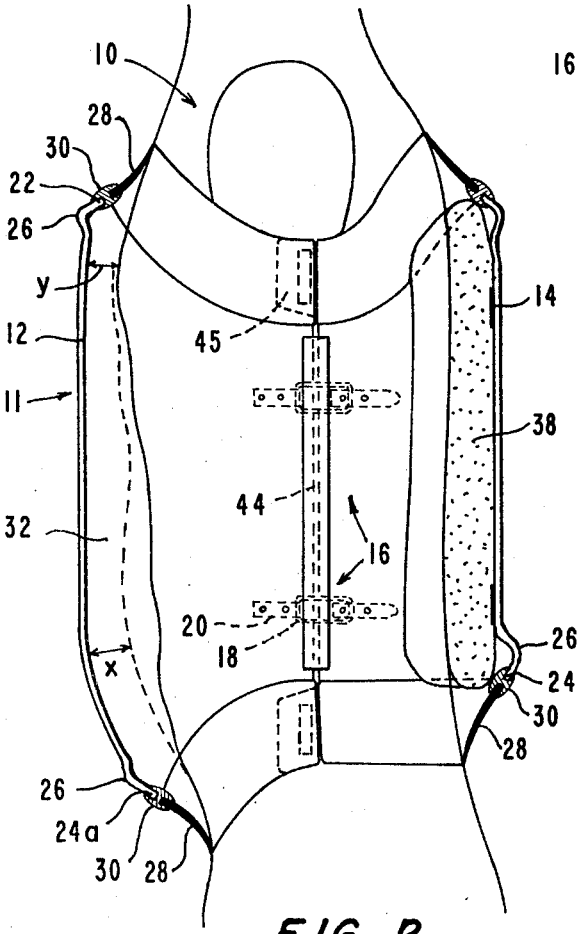
FIG. 2 is a diagrammatic, partially sectioned enlargement of part of FIG. 1.

In FIGS. 1 and 2, a male patient 10 is shown wearing a respirator shell 11 in accordance with the invention. The patient may, for example, be a paralysis victim requiring respiratory assistance, either at all times or perhaps only while sleeping. Shell 11 extends about the torso of the patient passing under his arms and consists of two fiberglass half shell sections 12, 14 which are not identical and are respectively shaped to serve as ventral and dorsal sections. Half shell sections 12, 14 co-operate to encircle the major part of the rib cage, the diaphragm and the abdomen of the patient 10. For inducing respiration, the diaphragm and abdomen must be largely covered.

Shell sections 12, 14 are firmly secured together at opposite sides of the body by respective pairs of clamps 16, 16*a*. These clamps include co-operating displaceable rings 18 and hooks 20.

Each shell section 12, 14 has an upper edge 22 which recedes downwardly in passing from the top centre of the section to the sides so that the top centre of the section overlies the uppermost part of the sternum or backbone of the patient while the sides lie under the arm pits. The dorsal shell section 14 terminates at its lower end in an edge 24 of substantially uniform level while the ventral shell section, 12 has a bottom edge 24*a* which tends gradually downward in passing from the sides of the section to a centre point almost at the pubic bone.

Shell sections 12, 14 are configured adjacent their upper and lower edges to include out-turned strengthening ribs 26. The free margins of these ribs are directed inwardly and mount respective resiliently flexible rubber sealing lips 28 each of which is sealingly secured to its associated shell section by conventional plastized beading or weatherstrip 30.

Figure 4A:
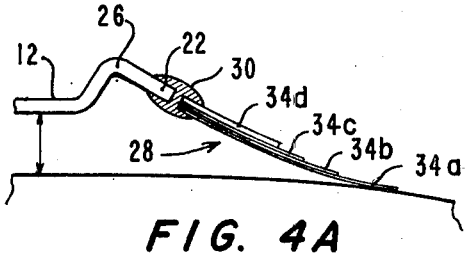
FIG. 4A is a sectioned detail of the region A of FIG. 1.

Sealing lips 28 are intended to flex upwardly to press against the skin of the patient and so co-operate to bound an airtight chamber 32 within the cuirass on application of negative pressure therein. In use, such pressure is developed periodically to induce artificial respiratory movement of the patient's abdomen and diaphragm. For enhanced sealing effect, each sealing lip is tapered, in this instance by forming it of four overlaid strips of rubber 34*a*, 34*b*, 34*c*, 34*d* of successively reducing width (FIG. 4*a*). This arrangement results in a sealing lip of variable resilience, that is, of a resilience which is variable across its width. On application of negative pressure within chamber 32, while the pressure of engagement of rubber strips 34*a* against the skin is increased, there is no tendency, because of the tapered nature of the lips, for the lips to overturn and/or to be sucked in towards the lower pressure region. On the other hand, when air is surged back into the chamber, engagement of the lips will tend to be relieved, that is they will lift from the skin, thus providing a desirable degree of fresh air for the enclosed skin surface and thereby minimizing the problem of skin irritation prevalent with dependants of conventional iron lungs. In general, it is believed that the illustrated seal structure affords a more reliable airtight seal for the shell chamber than hitherto obtainable with prior disclosed arrangements.

Figure 5B:
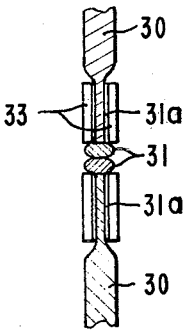
FIG. 5B is a cross-section on the line 5B—5B in FIG. 5A.
Figure 5A:
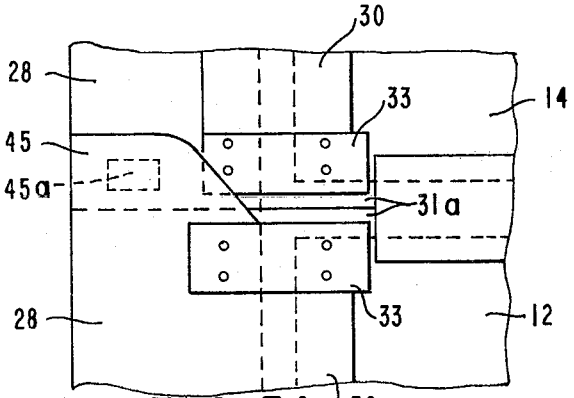
FIG. 5A is an elevational view of one end of a line of intersection of the shell sections of the respirator shell.

For sealing the joints between the two shell sections and thereby ensuring the airtight nature of chamber 32, channelled nylon or synthetic rubber seals 44 may be fixed to one or other of the opposed margins of the shell sections, while the abutting ends of the sealing lips 28 may be overlaid with tab portions 45 which extend integrally from one of the lips and are secured to the other by co-operating Velcro pads 45*a*. The sealing of these regions is further assisted by the arrangement detailed in FIGS. 5*a* and 5*b*. The opposed ends of weatherstrips 30 carry pad elements 31 housed in overturned rubber flaps 31*a* which are clamped to the weatherstrips between respective pairs of clamp plates 33. On locking the shell sections together pad elements 31 press together and also deform longitudinally to seal up the area of intersection of the sealing lips 28 and seals 44.

Since the wearer of the shell will normally be an invalid patient requiring support, the dorsal shell section 14 is provided with an airflow rubber cushion 38 supported within a removable linen case and secured to the shell section by engagement, for example, of appropriately spaced Velcro pads. When the patient is supine, additional cushion 43, 43*a* (FIG. 1) are required externally of the cuirass beneath the patient's head and buttocks to complement internal cushion 38. To further assist the patient, shoulder straps 42 (not shown) may be provided.

Figure 4B:
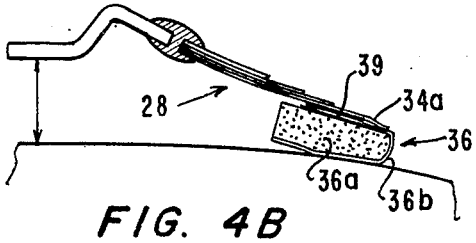
FIG. 4B illustrates an alternative seal structure to that shown in FIG. 4A which enhances sealing in certain difficult circumstances.

While sealing lips 28 are generally found to afford satisfactory seals, there are circumstances, such as in the pelvic region of ventral shell section, where it is desirable to locally pad the patient's torso in order to assist proper sealing by a lip 29. Typically, this need may arise where the gap between the shell margin and the skin exceeds 25 mm. To meet this need, the sealing lip may, carry at or adjacent its outer edge one or more flexible and compressible pads which may be of the form indicated at 36 in FIG. 4*b*. Here, the pad is a wad of low density plastics foam 36*a* covered on three faces with a thin latex film 36*b* to render it airtight, and disengageably fastened to the broadest strip 34*a* of lip 28 by Velcro pads 39.

As already mentioned, respiration is induced in patient 10 by intermittently applying a negative pressure or vacuum to chamber 32 to induce respiratory movement of the abdomen and diaphragm. Suction is applied, and relieved, through port 32*a* in ventral shell section 12. The method of obtaining respiration is therefore similar to that of the conventional iron lung except that the vacuum is applied only to those parts of the body actually involved in the respiratory process.

Fitting a patient with an inventive respirator shell is an entirely individual operation requiring the taking of an initial plaster cast of the patient's torso and then wrapping a templated enlargement thereof in fiberglass cloth. It is found that a suitable clearance Y of the front half shell 12 at the sternum is of the order of 20 to 25 mm while 50 mm or so is suitable immediately below the diaphragm. At the abdomen, a minimum clearance x (FIG. 2) at inhalation of 25 mm is preferred. At the back, the rubber cushion 38 is advantageously about 35 to 40 mm thick. With these arrangements, a typical volumetric capacity of chamber 32 is of the order of 10 to 15 liters.

Figure 7:
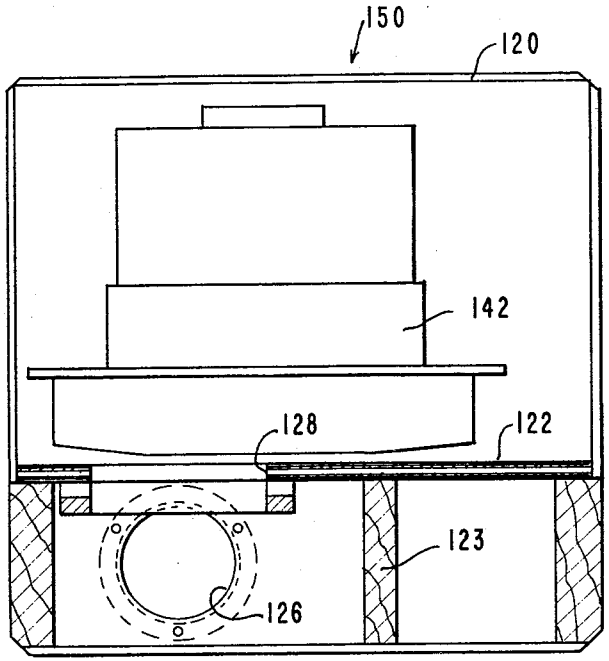
FIG. 7 is a side elevation on the line 7—7 in FIG. 6.
Figure 8:
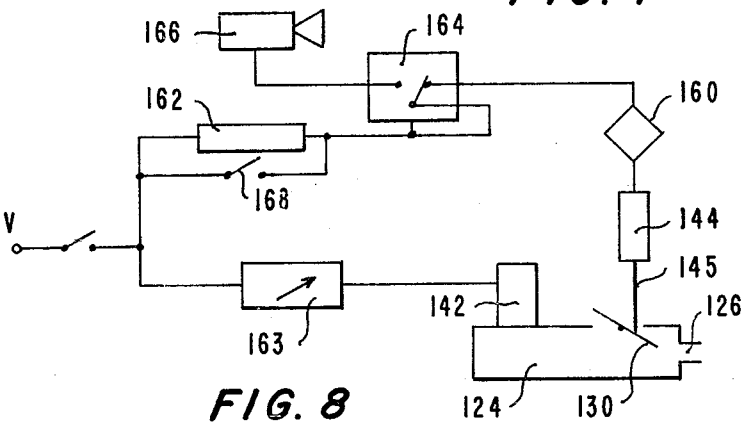
FIG. 8 is a circuit diagram for the power unit of FIGS. 6 and 7
Figure 6:
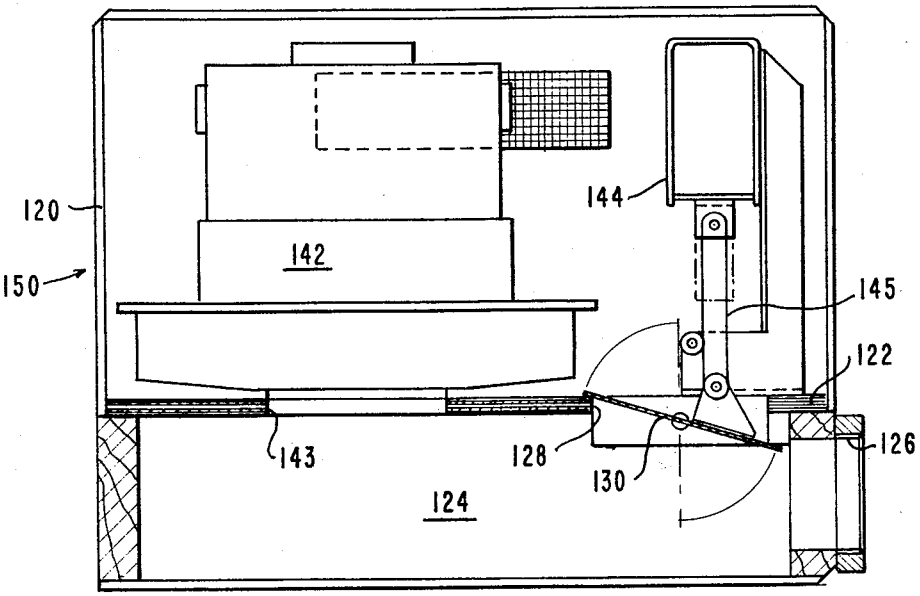
FIG. 6 is a vertical cross-section through a power unit for the cuirass of FIGS. 1 and 2.

A simple power unit 150 for applying the required vacuum to chamber 32 is illustrated in FIGS. 6 to 8. Unit 150 includes an outer casing 120 at the side of which a suction cavity 124 is determined by a pair of internal partitions 122, 123. Continuous air suction is applied to cavity 124 by a motor and fan unit 142 which draws air through an opening 143 in partition 122. Cavity 124 has two outlet ports; a first, 126, is adapted to be coupled to a flexible conduit (not shown) by which negative pressure in cavity 124 is applied to the respirator shell by way of intake port 32*a*. A second outlet port 128, disposed between opening 143 and port 126 and exposed to atmosphere, has valve means in the form of a time controlled butterfly damper 130 by which the degree of vacuum in the chamber may be intermittently and temporarily reduced to achieve the required intermittent relaxation of negative pressure within shell 11.

Damper 130 is opened and closed by a solenoid actuator 144 acting on a connecting rod 145. By pivoting damper 130 across port 128, an arrangement is obtained where, on opening port 128, damper 130 pivots down to restrict the flow path between port 128 and opening 143. The valve is therefore simultaneously both a relief to atmosphere and a restrictor to the direct flow from port 126 to opening 143, thus assisting the return of the shell interior to ambient atmosphere pressure. FIG. 8 is a control circuit diagram for the power unit of FIGS. 6 and 7. AC mains current V is applied directly to motor and fan unit 142, and to solenoid actuator 144 by way of bridge rectifier 160. An adjustable twin timer 162 in series with the actuator allows individual determination of the duration of both the vacuum and relieve portions of the air cycle. The degree of vacuum achieved is subject to the controllable duration of the time of application and to the speed of unit 142, which is also adjustable at 163. A safety device is incorporated to ensure that an alarm is raised on failure of the power supply or other component. This device comprises a delay-on timer 164 in the line to actuator 144 which sets off an alarm buzzer 166 in the event that twin timer 162 does not switch states within a predetermined time. The operation of the safety provision may be tested by closing a switch 168 to short out timer 162.

Figure 9:
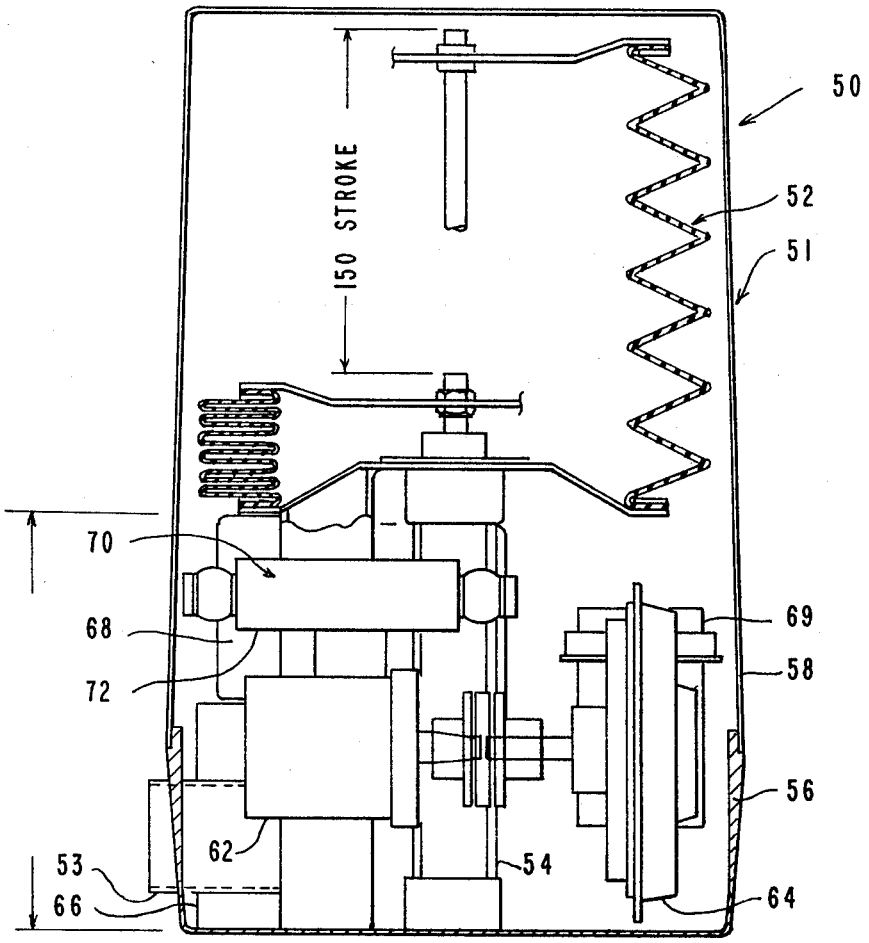
FIG. 9 is an internal side view of an alternative power unit.
Figure 10:
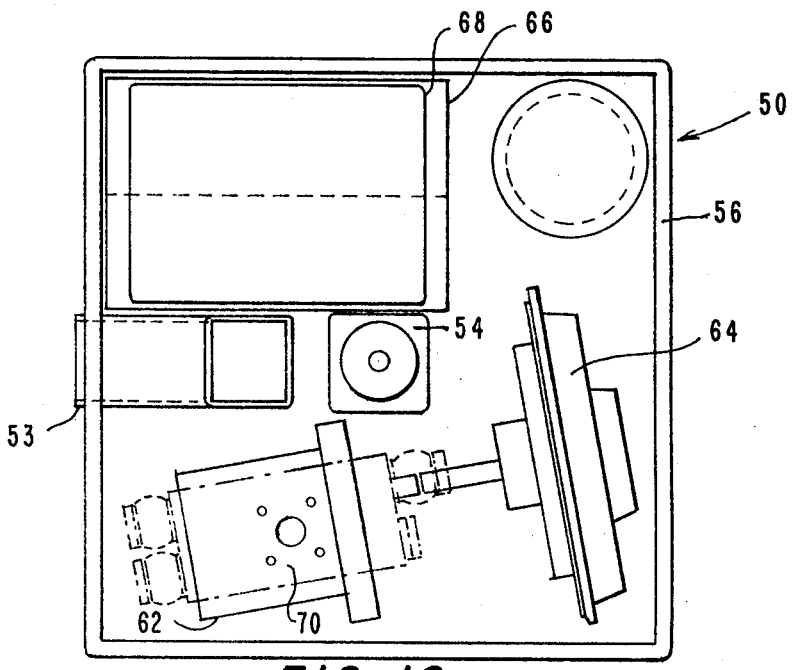
FIG. 10 is a cross-section on the line 10—10 of FIG. 9.
Figure 11:
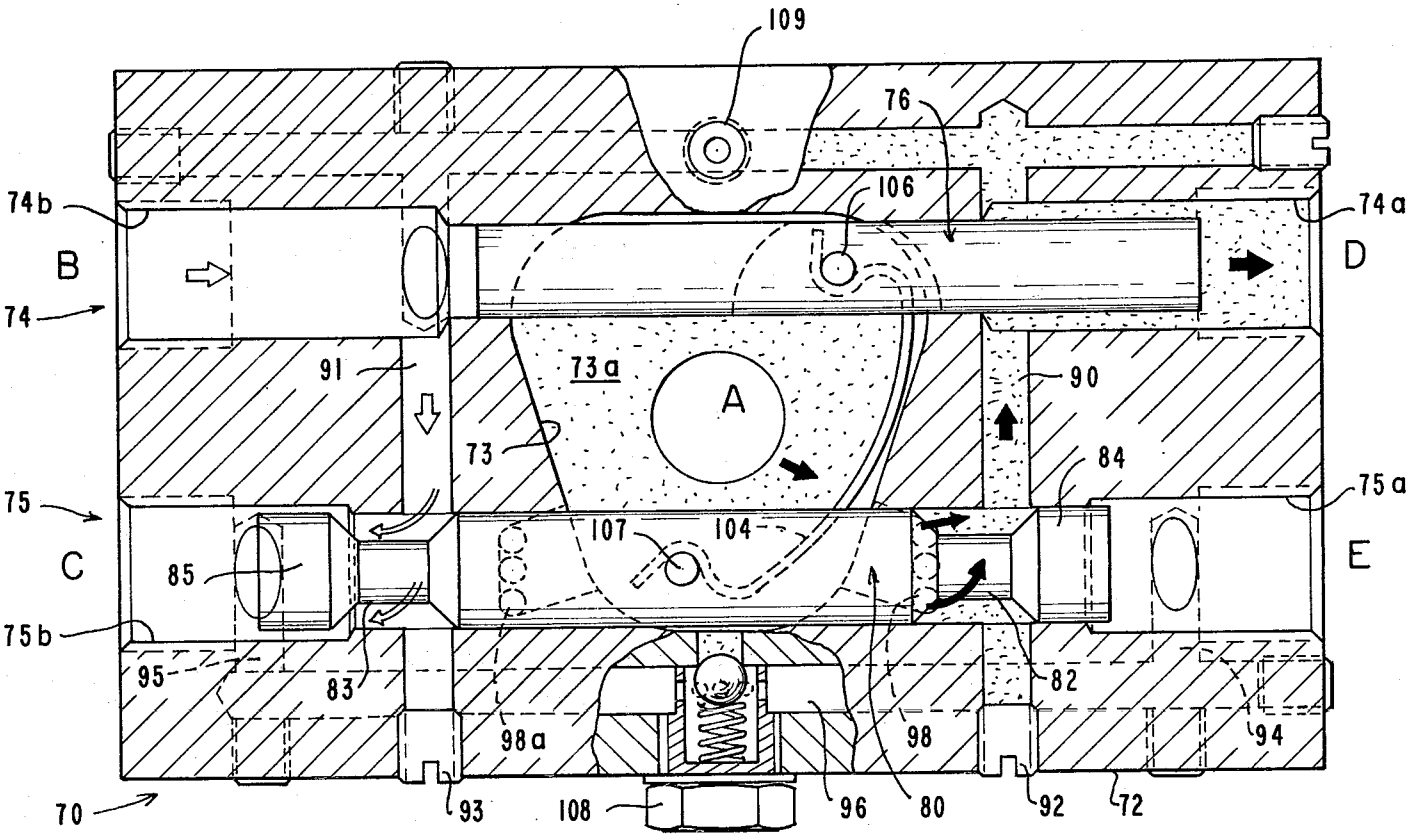
FIG. 11 is a cross-section through the reciprocating valve forming part of the unit shown in FIGS. 9 and 10.

Turning now to FIGS. 9 to 11, there is there described a more sophisticated power unit employing a novel design reciprocatory valve. The vacuum is applied and relaxed by a conventional bellows unit 52 disposed in the upper part of a housing 51 made up of a relatively shallow tray bottom 56 and a separable cover 58. Bellows 52 communicates with chamber 32 by way of a flexible duct 53 and is actuated by a double acting hydraulic cylinder 54 fixed to tray 56. Hydraulic fluid for driving cylinder 54 is provided by a gear pump 62 driven by a small power 12 volt electric motor 64 associates with a control switch and a speed control rheostat. It is found that motor 64 need only have a rating o the order of 90 watts—a value which is of course very much less than that required of conventional iron lungs. In view of this low power requirement, it is practical to render the power unit portable and to include an emergency current supply within housing 50 in the form of a pair of sealed lead acid batteries 66. Power is normally derived from the mains by way of a transformer rectifier unit 68 which also acts to charge batteries 64. Desirably, provision is additionally made for deriving power from the cigarette lighter socket of a motor vehicle to facilitate transport of a passenger wearing the respirator device. Two other principal components seat on tray 56, namely an oil surge reservoir 69 and a reciprocatory valve 70 communicating pump 62 with cylinder 54. For clarity of illustration, FIGS. 9 to 11 do not generally show the various electrical and hydraulic connections between the components of power unit 50.

Reciprocatory valve 70 is shown in greater detail in FIG. 11 and embodies a further aspect of the invention. Valve 70 includes a solid body 72 through which pass a pair of spaced but parallel longitudinally directed bores 74, 75. The two bores are of similar diameter and are divided by a centrally disposed cavity 73 extending from one face of the valve body almost to the other face. Bore 74 is enlarged slightly at its respective ends by counterbores 74*a*, 74*b*, the openings of which to the exterior define outlet ports D,B. Sealingly mounted within bore 74 is a first sliding member in the guise of a pilot piston 76. Piston 76 is reciprocable in the bore between respective positions in which opposite ends of the rod project substantially into the enlarged end portions 74*a*, 74*b* of the bore 74.

Bore 75 is similarly enlarged at its ends by counterbores 75*a*, 75*b* which are, however, of lesser extent than counterbores 74*a*, 74*b*. The openings of counterbores 75*a*, 75*b* comprise ports E,C. Bore 75 sealingly slidingly receives a second sliding member in the form of a valve piston 80 having respective annular grooves 82, 83 set a little in from opposite ends which thereby comprise head portions 84, 85.

The end portions of bore 74 communicate with opposite ends of the bore 75 inwardly of counterbore portions 75*a*, 75*b* by way of transverse bores 90, 91, which open from the valve body but are closed by respective plugs 92, 93. The enlarged end portions 75*a*, 75*b* of bore 75 are also interconnected by a passage including closed transverse bores 94, 95 and a longitudinal bore 96 connecting bores 94, 95.

Opening into bore 75 at locations just inwardly of bores 90, 91 are two sets of fluid intake bores 98, 98*a* which themselves open to cavity 73. Cavity 73 is largely closed by a backing plate 73*a* through which is formed an inlet port A.

Cavity 73 is occupied by compression spring means in the form of a wire spring 104 which seats on respective bosses 106, 107 on pistons 76, 80.

The operation of the reciprocatory valve will now be described by way of reference to its function in the power unit 50. When so in place, inlet ports 98, 98*a* are arranged to receive fluid from the outlet of pump 62 by way of port A. Ports B,D are connected to the two intake ports of cylinder 54 at either side of its piston. Port E is closed off while port C leads to the oil surge reservoir which in turn supplies the gear pump. Thus, in the position shown in FIG. 9, fluid flows from inlet ports 98 by way of transverse bore 90 to outlet port D. As the piston in cylinder 54 is, say, raised, returning fluid at port B is expelled by way of transverse bore 91 and port C to the oil surge reservoir. Spring 104 is biasing pistons 76, 80 in opposite directions, namely respectively into bore enlargements 74*a*, 75*b*, the limits being determined by abutment of the spring on the sides of cavity 73. At any time, while the cylinder piston is moving and flow of fluid occurs from A to D, there is also a considerable pressure decrease between the two ports. However, when the piston of cylinder 54 reaches the end of its stroke, flow of fluid ceases and pressures equalize. Thus the pressure at outlet port D attains such a level that the fluid pressure acting at that end of piston 76 begins to overcome the force of spring 104. The piston moves back towards the port B until the point of maximum compression of the spring is attained when boss 106 lies directly opposite boss 107. On slight further movement of piston 76, spring 104 suddenly forces the two pistons apart to take up positions opposite to their previous positions. Pilot piston 76 moves into bore part 74*b* and valve piston 80 moves to a position in which transverse bore 90 is open to bore enlargement 75*a* while inflowing fluid can travel to port B, and thence to cylinder 54, from inlet openings 98*a* by way of transverse bore 91. Returning fluid entering bore enlargement 74*a* passes to port C by way of longitudinal subsidiary bore 96. In due course the pressure at port B attains a level sufficient to force piston 76 back and the valve again reverses its setting.

It will be seen that presence of incoming fluid in cavity 73 serves to lubricate the movement of the pistons and the spring.

Valve 70 may also be provided if desired with a relief bleed 108 operable to relieve cavity 73 and a suitable metering valve 109 in communication with ports B,D.

It will be appreciated that the reciprocatory valve which can be viewed as a 5 port—threshold pressure set threshold pressure reset—self reciprocatory valve, could have numerous applications in branches of industry where reciprocating motion is used, such as, for example, in distributing conveyors, cutting knives in papermaking industry, reciprocating machine tools and pumps. The valve can, in fact, turn any double acting pneumatic or hydraulic cylinder into an automatically reciprocating unit or motor.

I claim:

1. A portable negative pressure respirator shell comprising a plurality of generally curved and substantially rigid shell sections cooperable to provide an open ended shell which embraces a patient's torso when worn by the patient, being positioned to extend downwardly from over the chest about the diaphragm and abdomen to define a chamber between the shell and the patient's torso, port means to permit application of a negative pressure to said chamber, and resilient flexible sealing lips formed of overlaid strips of resilient material of successively reducing width disposed along longitudinally spaced edges of the shell sections which bound the open ends of the assembled shell, said lips being of outwardly increasing flexibility, thereby to aid in providing an airtight engagement with the body surface of the patient on the application of a negative pressure to said chamber.

2. A portable negative pressure respirator shell comprising a plurality of generally curved and substantially rigid shell sections cooperable to provide an open ended shell which embraces a patient's torso when worn by the patient, being positioned to extend downwardly from over the chest about the diaphragm and abdomen to define a chamber between the shell and the patient's torso, port means to permit application of a negative pressure to said chamber, and resilient flexible sealing lips disposed along longitudinally spaced edges of the shell sections which bound the open ends of the assembled shell, said lips being of outwardly increasing flexibility thereby to aid in providing an airtight engagement with the body surface of the patient on the application of a negative pressure to said chamber, said shell sections having integral wholly outstanding ribs which extend adjacent said edges and include inturned longitudinally outwardly directed inclined marginal portions terminating at said edges, and wherein said sealing lips are rigidly coupled to said marginal portions of the outstanding ribs as inwardly inclined longitudinal extensions of the shell section.

3. A portable negative pressure respirator shell comprising a plurality of generally curved and substantially rigid shell sections cooperable to provide an open ended shell which embraces a patient's torso when worn by the patient, being positioned to extend downwardly from over the chest about the diaphragm and abdomen to define a chamber between the shell and the patient's torso, port ments to permit application of a negative pressure to said chamber, and resilient flexible sealing sections which bound the open ends of the assembled shell, said lips being of outwardly increasing flexibility thereby to aid in providing an airtight engagement with the body surface of the patient on the application of a negative pressure to said chamber, and a beading along said edges, the sealing lips being coupled to said edges by being partially encased in the beading to form a mechanically rigid connection with said edges.

4. A respirator comprising a plurality of generally curved and substantially rigid shell sections cooperable to provide an open ended shell which embraces a patient's torso when worn by the patient, being positioned to extend downwardly from over the chest about the diaphragm and abdomen to define a chamber between the shell and the patient's torso, port means to permit application of a negative pressure to said chamber, and resilient flexible sealing lips disposed along longitudinally spaced edges of the shell sections which bound the open ends of the assembled shell, said lips being of outwardly increasing flexibility, thereby to aid in providing an airtight engagement with the body surface of the patient on the application of a negative pressure to said chamber;

structure defining a cavity having an air intake port open to atmosphere and a suction port communicable with the port means of the shell;

means for applying continuous air suction to said cavity to induce a vacuum therein; and valve means to intermittently and temporarily reduce the degree of vacuum in said cavity, which valve means includes a butterfly damper rotatable between a position closing said air intake port and a position allowing air inflow through said air intake port whilst simultaneously substantially restricting air inflow through said suction port, thus reducing the suction applied to said chamber within the shell.

5. A power unit according to claim 4 further comprising a partition defining one wall of the cavity, wherein the air suction means and the air intake port open to said cabity in a common plane through the partition.

6. A power unit according to claim 4 wherein the air intake port and suction port are adjacent each other in respective walls of said cavity and wherein the butterfly damper is rotatably mounted substantially diametrally of the air intake port.

7. A respirator device according to claim 1, 2, 3, 4, 5 or 6 wherein the sealing lips are of reducing thickness and increasing resilience in a direction outwardly of the respective edges.

8. A respirator device according to claim 1, 2, 3, 4, 5 or 6 wherein at least one of the sealing lips carries at or adjacent a portion of its outer margin a flexible and compressible pad as a further aid in establishing said airtight engagement.

9. A respirator device according to claim 1, 2, 3, 4, 5 or 6 further including a cushion fitted internally within one shell section.

10. A power unit for applying intermittent negative pressure to a chamber defined by a respirator shell, comprising:

structure defining a cavity having an air intake port open to atmosphere and a suction port communicable with the port means of the shell;

means for applying continuous air suction to said cavity to induce a vacuum therein; and valve means to intermittently and temporarily reduce the degree of vacuum in said cavity, which valve means includes a butterfly damper rotatable between a position closing said air intake port and a position allowing air inflow through said air intake port whilst simultaneously substantially restricting air inflow through said suction port, thus reducing the suction applied to said chamber within the shell.

11. A power unit according to claim 10 further comprising a partition defining one wall of the cavity, wherein the air suction means and the air intake port open to said cavity in a common plane through the partition.

12. A power unit according to claim 10 wherein the air intake port and suction port are adjacent each other in respective walls of said cavity and wherein the butterfly damper is rotatably mounted substantially diametrally of the air intake port.

13. A respirator device according to claim 2, 3, 4, 5 or 6 wherein the sealing lips are formed of overlaid strips of resilient material of successively reducing width.

* * * * *